United States Patent [19]

Pringle

[11] 4,373,587

[45] Feb. 15, 1983

[54] FLUID DISPLACEMENT WELL SAFETY VALVE

[75] Inventor: Ronald E. Pringle, Houston, Tex.

[73] Assignee: Camco, Incorporated, Houston, Tex.

[21] Appl. No.: 214,069

[22] Filed: Dec. 8, 1980

[51] Int. Cl.[3] ..... E21B 34/10

[52] U.S. Cl. ..... 166/324; 251/53; 166/72

[58] Field of Search ..... 251/53, 51; 166/322, 166/323, 324, 72

[56] References Cited

U.S. PATENT DOCUMENTS

| | | | |
|---|---|---|---|
| 3,782,461 | 1/1974 | Watkins | 166/72 |
| 4,014,386 | 3/1977 | Johnson et al. | 166/321 |
| 4,252,197 | 2/1981 | Pringle | 166/324 |

*Primary Examiner*—William F. Pate, III

*Attorney, Agent, or Firm*—Fulbright & Jaworski

[57] ABSTRACT

In a well safety valve for controlling the fluid flow through a well conduit in which the valve has a housing and a flow tube controlling a valve element, the improvement in means for opening and closing the valve. A gas chamber is positioned in the housing with a fluid passageway positioned between the gas chamber and a port for receiving fluid pressure from the well surface for increasing the pressure of the gas in the chamber. One or more pistons are movably positioned in the passageway between the gas chamber and the port with the pistons restricting but allowing fluid flow through the passageway. The pistons are connected to the flow tube whereby when pressure on the port side of the pistons is reduced compressed gas in the gas chamber will act on the fluid in the gas chamber side of the piston to move the pistons in a direction to close the valve. A check valve may be in parallel with the pistons for quickly pressuring the gas chamber. The gas chamber is sealless whereby charged gas will be prevented from escaping. The gas chamber may be an enclosure with a fluid port at the bottom or may include an enclosed bellows. Actuator rods may be connected between the pistons and the flow tube and the rods may be either exposed to tubing pressure in the bore to act to close the valve or may be pressure balanced by being exposed on both ends to tubing pressure in the bore. A spring may be provided to bias the flow tube in a direction to open the valve.

16 Claims, 6 Drawing Figures

Fig. 2
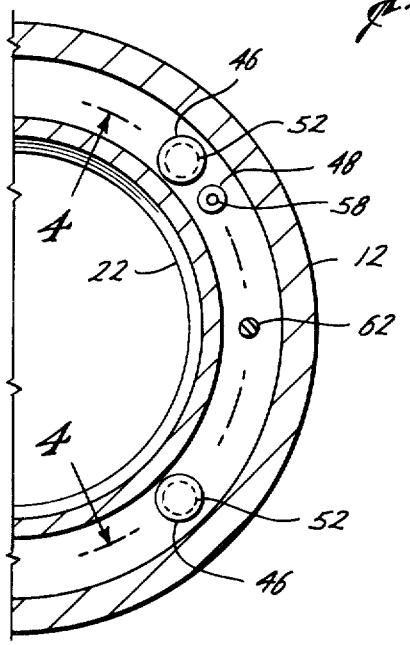
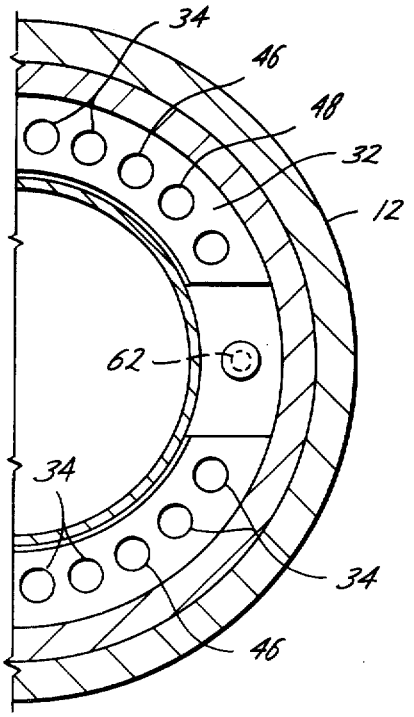
Fig. 3
Fig. 5
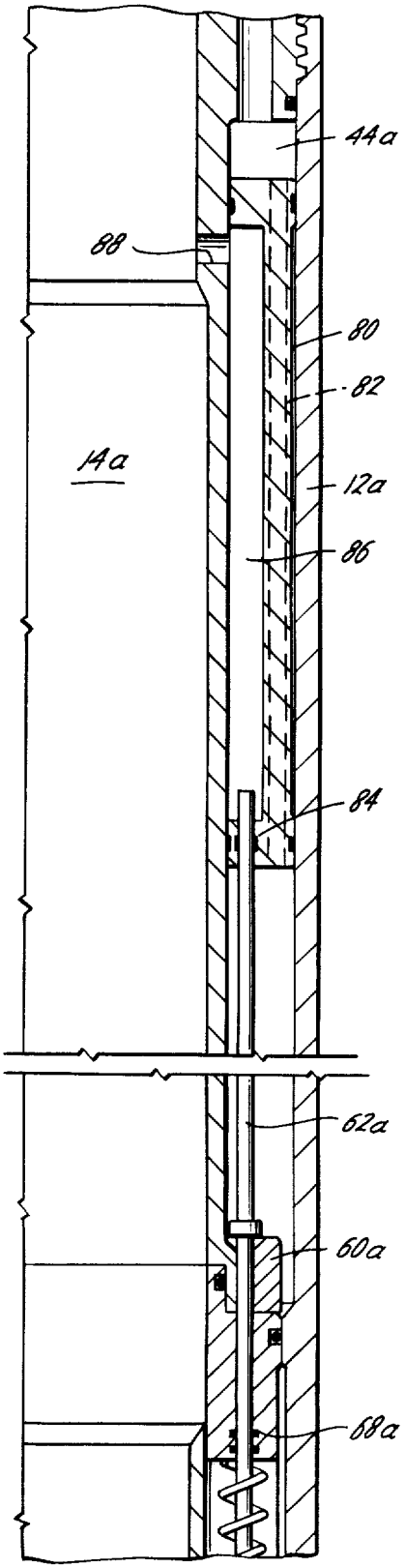

FLUID DISPLACEMENT WELL SAFETY VALVE

BACKGROUND OF THE INVENTION

It is old to provide well safety valves, such as disclosed in U.S. Pat. No. 3,782,461 and in co-pending U.S. patent application Ser. No. 027,207, filed Apr. 5, 1979, having a gas chamber for closing the valve and in which the valve is actuated to an open position by hydraulic pressure from the well surface. However, in utilizing such safety valves in extreme deep set applications, the control fluid hydrostatic pressure in the hydraulic flow control line may be in excess of 5,000 psi. While conventional safety valves may be charged to provide a closing pressure greater than 5,000 psi to overcome the existing hydrostatic pressures, excessive friction is created on any seals and the possibility of losing the charged gas, which would cause the valves to fail in the open position, is present.

The present invention is directed to providing a well safety valve which can be utilized at greater depths in wells which can be actuated by small differentials in the hydraulic control lines, and in which the gas in the closing gas chamber is unlikely to escape.

SUMMARY

The present invention is directed to a subsurface well safety valve having a housing with a bore therethrough and a flow tube controlling a valve element which moves between an open and closed position in the bore. Means are provided for biasing the flow valve in a first direction for causing the valve closure member to move to the open position. A gas chamber is provided in the housing and a fluid passageway is positioned in the housing and adapted to receive fluid pressure from the well surface for increasing the pressure of the gas in the chamber. The passageway includes a restriction limiting fluid flow out of the housing. Piston means are provided in the housing connected to the flow tube having a first end exposed to pressure on a first side of the restriction and having a second end exposed to pressure in the passageway on the second side of the restriction and subject to the pressure in the gas chamber. When pressure on the first side of the restriction is reduced, the compressed gas will act on the fluid on the second side of the restriction to move the piston means in a direction to close the valve.

A still further object of the present invention is wherein the restriction includes a check valve in parallel with the piston means for quickly pressuring the gas chamber.

Yet a still further object of the present invention is wherein the gas chamber is sealless whereby charged gas will be prevented from escaping. The gas chamber may include an enclosure with a fluid port at the bottom and/or an enclosed bellows.

Still a further object of the present invention is the provision of a valve upstream of the restriction for initially pressurizing the passageway and chamber with gas.

A further object of the present invention is the provision wherein the piston means in the passageway restricts, but allows fluid flow through the passageway.

Another object of the present invention is the provision of actuator rod means in the housing connected between the piston means and the flow tube. The rod means may be exposed on one side to pressure in the bore acting in a direction to close the valve with the second end of the rod means exposed to hydraulic control pressure from the well surface in a direction to open the valve. In another embodiment the actuator rod means is exposed on opposite ends to pressure in the bore whereby the rod means is insensitive to pressure in the bore.

Another object of the present invention is wherein the cross-sectional area of the piston means is greater than the cross-sectional area of the rod means to insure closing of the safety valve upon releasing the surface control hydraulic pressure.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 2 is a cross-sectional view taken along line 2—2 of FIG. 1A, FIG. 3 is a cross-sectional view taken along line 3—3 of FIG. 1B, FIG. 5 is a fragmentary elevational view, partly in cross section, of another embodiment of the present invention which is pressure balanced by and is insensitive to pressure in the valve bore.

BRIEF DESCRIPTION OF THE PREFERRED EMBODIMENT

Figure 1A:
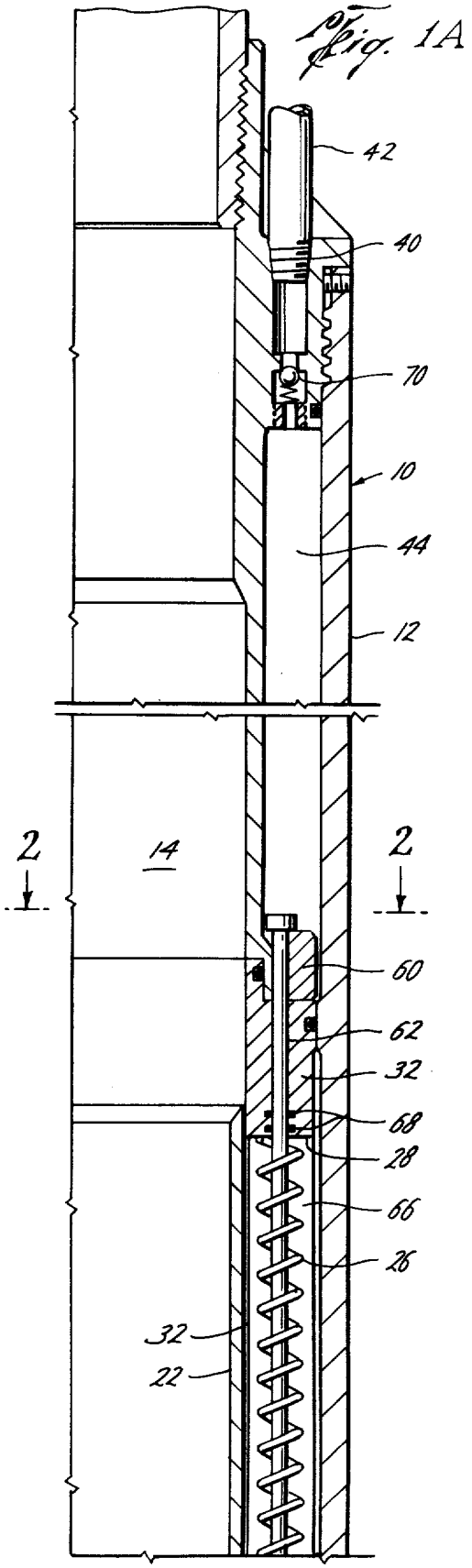
FIGS. 1A and 1B are continuations of each other of a fragmentary elevational view, partly in cross section, of a well safety valve utilizing one form of the present invention and shown in the open position.
Figure 1B:
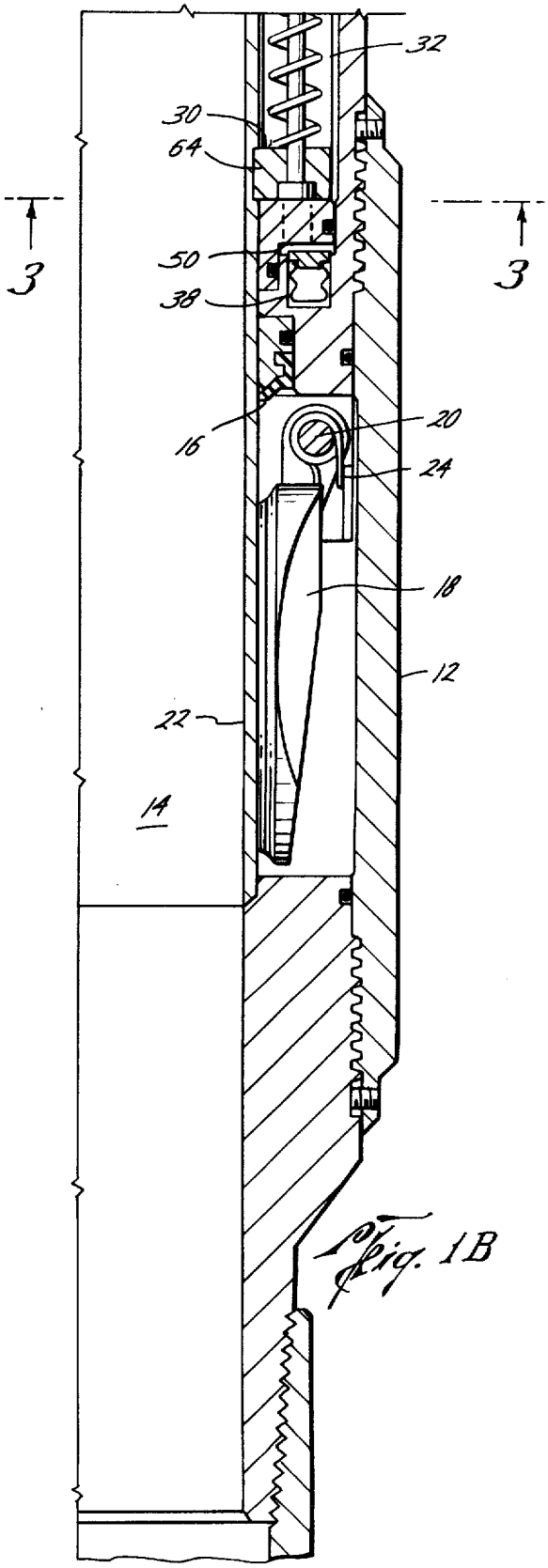
Figure 4:
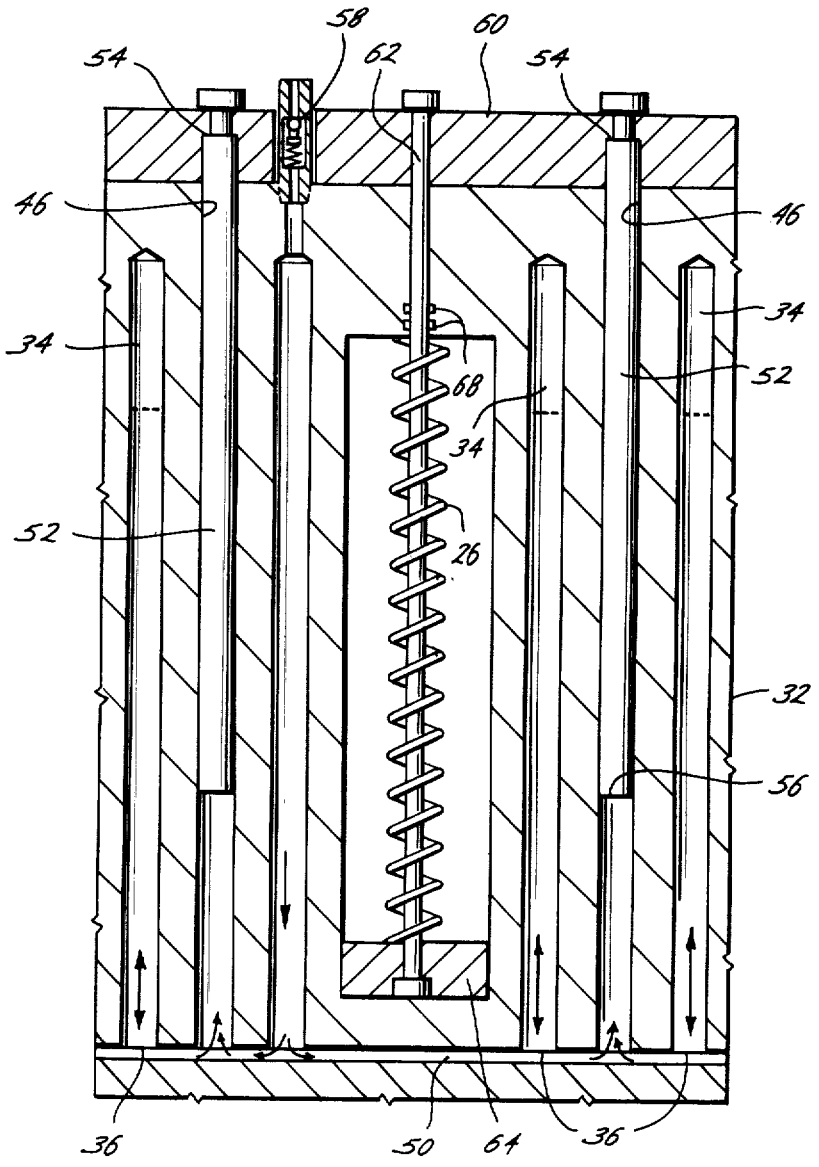
FIG. 4 is a cross-sectional view taken along line 4—4 of FIG. 2.

Referring now to the drawings, and particularly to FIGS. 1A and 1B, the safety valve is generally indicated by the numeral 10 and has a housing 12 including a bore 14 therethrough having a valve seat 16, a suitable valve closure element such as a flapper valve 18 connected to the housing 12 by pivot pin 20. Under normal operating conditions, the safety valve 10 is open to allow well production through the bore 14, but the safety valve 10 may be closed from the well surface in the event abnormal conditions occur.

A tubular member or flow tube 22 is telescopically movable in the housing 12 and through the valve seat 16. As best seen in FIG. 1B, when the flow tube 22 is moved to a downward position, the tube 22 pushes the flapper 18 away from the valve seat 16. Thus, the valve 10 is held in the open position so long as the tube 22 is in the downward position. When the flow tube 22 is moved upwardly, the flapper 18 is allowed to move upwardly on to the seat 16 by the action of a spring 24 and/or also by the action of fluid flowing upwardly through the bore 14 and behind the flapper 18.

Means may be provided for biasing the flow tube 22 in a first direction for causing the valve closure member 18 to move to the open position such as a spring 26 acting against a first shoulder 28 in the housing 12 and against a second shoulder 30 connected to the flow tube 22.

Referring now to FIGS. 1A, 1B, 3 and 4, an annular member 32 is positioned in the body 12. A gas chamber is provided which may include a plurality of cavities 34 drilled from the bottom in the annular member 32 and having entrance ports 36 at the bottom of the cavities 34. As an alternative or as an addition to the cavities 34, an enclosed annular gas-filled bellows 38 may be provided. A fluid passageway is positioned in the housing leading from a port 40 which is adapted to be connected to a control line 42 leading to the well surface for connection to a hydraulic fluid supply for providing hydraulic control fluid for actuating the valve 10. The fluid passageway leads from the port 40 to the gas chambers including cavities 34 and bellows 38 for increasing the pressure of the gas therein. The passageway includes a portion 44 in communication with the port 40 and one or more portions 46 and may include passageway 48, all through the annular member 32, and annular passageway 50 which is in communication with the ports 36 and the bellows 38. Thus, by applying hydraulic pressure from the well surface to the ports 40, hydraulic fluid may flow through the passageways 44, 46, 48, 50 and compress the gas in the chambers 34 and 38. It is particularly noted that charged gas in chambers 34 and 38 is not exposed to seals and thus is not subject to escaping.

The passageway includes a restriction limiting fluid flow. One or more pistons 52 such as four, may be provided in the passageways 46 which restrict, but allows fluid flow through the passageways 46. Thus, the pistons 52 have first ends 54 exposed to pressure in the passageway 44 from the port 40 and second ends 56 exposed to the pressure in the gas chambers 34 and 38. Thus, when hydraulic fluid is applied to the port 40 and to the passageway, hydraulic fluid will flow through the passageways 44 and in the passageways 46 around the pistons 52 for compressing gas in the chambers 34 and 38. However, when pressure is relieved at the port 40, the compressed gas in the gas chambers 34 and 38 will act against the ends 56 of the piston 52 moving them upwardly. As an alternative to the piston forming the restriction, a small orifice may be provided in parallel with the pistons 52.

In order to more quickly compress the gas in the chambers 34 and 38, a check valve 58 may be provided in passageway 48 which is in parallel with the passageways 46 whereby hydraulic fluid from the port 40 may flow through the passageway 48 in a direction to compress the gas in the gas chambers 34 and 38, but prevent reduction of the gas pressure through passageway 48.

The pistons 52 are connected to and actuate the flow tube 22 by being connected to a ring 60 (FIGS. 1A and 4) which is in turn connected to one or more, preferably two, actuator rods 62 which are connected in turn to connector 64 to the flow tube 22. The actuator rods 62 pass through a groove 66 in annular member 32 and through seals 68. Therefore, movement of the pistons 52 will cause longitudinal movement of the flow tube 22. It is also to be noted in the embodiment shown in FIG. 1A that the actuator rods 62 are subjected above the seal 68 to the hydrostatic and control fluid pressure in the control line 42 acting in a direction to move the flow tube 22 downwardly opening the valve element 18 while tubing pressure in the bore 14 acts on the actuator rods 62 below the seals 68 in a direction to move the flow tube 22 upwardly closing the valve closure member 18.

In order to provide a high closing force, it is preferable to precharge the gas in the cavities 34 and bellows 38 with gas such as nitrogen. Thus, when assembling the valve 10, the annular bellows 38 is precharged with nitrogen. In addition, the gas in the cavities 34 may be precharged by turning the valve 10 upside down and inserting a charge of compressed nitrogen through the port 40 through a check valve 70 whereby the fluid passageways 44, 46, 48, 50 and 34 will be precharged. The valve 10 may then be inserted in the tubing and the check valve 70 will remain in place until the valve 10 is inserted in the well and hydraulic pressure through the control line 42 overcomes the ball 70 for operation of the valve 10. In addition, it is preferable that the cross-sectional area of the pistons 52 be larger than the cross-sectional area of the actuator rods 62, such as eight times, to provide a suitable safety factor to close the safety valve 10 upon releasing surface control hydraulic fluid through the control line 42.

Since the hydraulic control fluid exerts a hydrostatic force on the actuator rods 62 above the seals 68, opposing the upward force on the actuator rods 62 by the pressure in the bore 14, the hydrostatic force provides biasing on the flow tube 22 in a direction to cause the valve closure member 18 to move to the open position. Therefore, in the case where the tubing pressure in the bore 14 is low, the biasing spring 26 may be omitted.

In operation, the embodiment of FIGS. 1-4 is inserted in a well tubing in a well bore, preferably with the gas in the chambers 34 and 38 charged and hydraulic pressure placed in the fluid control line 42. The hydraulic fluid in the control line 42 is pressured up to further charge the gas in the chambers 34 and 38. The spring 26 and the hydraulic forces acting on the actuator rod 62 bias the flow tube 22 downwardly to open the flapper valve 18. While hydraulic pressure from the control line 42 will also flow around the pistons 52 in their chambers 46, the hydraulic fluid will flow quickly through the check valve 58 and passageway 48 to quickly increase the gas pressure in the gas chambers for quick loading in preparation for any desired closing of the valve 10. After being in open position for a time, the control fluid pressure will equalize across the pistons 52. When it is desired to close the safety valve 10, the hydraulic control pressure in the control line 42 is released and the gas pressure in the chambers 34 and/or 38 will move hydraulic fluid and the pistons 52 upwardly carrying the actuator rods 62 upwardly which in turn will move the flow tube 22 upwardly to allow the flapper valve 18 to close and remain closed by tubing pressure acting behind the flapper valve 18. After the valve 10 closes, the control fluid pressure will equalize across the pistons 52 by leaking through the restriction or clearance between the pistons 52 and the cylinders 46. Then, after the tubing pressure is equalized across the flapper 18, as is conventional, the valve 10 will open by the spring force 26 and hydrostatic head pressures in the control line 42 acting on the cross-sectional area of the piston actuators 52 if these forces are greater than the force created by the tubing pressure acting on the valve actuator 62. If the tubing pressure is greater than the hydrostatic pressure in the control line, then pressure must be applied in the control line 42 to overcome the tubing pressure acting on the valve actuators 62.

However, the actuator rods may be balanced whereby all forces exerted by the tubing pressure in the bore and by the hydrostatic pressure in the flow control line on the actuator rods are equal. Referring now to FIG. 5, a further embodiment of the present invention is shown wherein like parts are numbered similarly to FIGS. 1-4 with the addition of the suffix "a". In this embodiment, an insert 80 is provided in the passageway 44*a* having an opening 82 therethrough whereby hydraulic flow control pressure can pass. The actuator rods 62a extend through the insert 80a between seals 84 into a cavity 86. An opening 88 is provided in the housing 12a between the cavity 86 and the bore 14a. Therefore, the actuator rods 62a are exposed above the seals 84 to tubing pressure in one direction and below the seals 68a to tubing pressure in the second direction whereby the actuator rods 62a are insensitive to tubing pressure. Similarly, the actuator rod 62a between the seals 84 and 68a are exposed to hydraulic control fluid in two directions and thus are balanced and is therefore insensitive to hydrostatic and fluid control pressure.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. A subsurface well safety valve for controlling the fluid flow through a well conduit comprising, a housing having a bore therethrough, a valve closure member positioned in the housing movable between open and closed positions in the bore, a flow tube longitudinally movable in the housing for controlling the movement of the valve closure member, means for biasing the flow tube in a first direction for causing the valve closure member to move to the open position, a sealless gas chamber in said housing, a fluid passageway positioned in the housing and adapted to receive fluid pressure from the well surface for increasing the pressure of the gas in the chamber, said passageway including a time delay restriction limiting fluid flow out of said housing for leaving a compressed gas in the gas chamber after the pressure from the surface is reduced, piston means in the housing connected to the flow tube, said piston means having a first end exposed to pressure in the passageway on a first side of the restriction, and having a second end exposed to pressure in the passageway on the second side of the restriction and subject to the pressure in the gas chamber whereby when pressure on the first side of the restriction is reduced the compressed gas will act on the fluid on the second side of the restriction to move the piston means in a direction to close the valve.

2. The apparatus of claim 1 wherein the restriction includes a check valve.

3. The apparatus of claim 1 wherein the restriction includes a limited space about the piston means.

4. The apparatus of claim 1 wherein the gas chamber includes a port in the bottom.

5. The apparatus of claim 1 wherein the gas chamber includes a bellows.

6. The apparatus of claim 5 wherein the bellows is enclosed and precharged.

7. The apparatus of claim 1 including, a valve upstream of said restriction for pressuring the passageway and gas chamber with gas.

8. A subsurface well safety valve for controlling the fluid flow through a well conduit comprising, a housing having a bore therethrough, a valve closure member positioned in the housing movable between open and closed positions in the bore, a flow tube longitudinally movable in the housing for controlling the movement of the valve closure member, means for biasing the flow tube in a first direction for causing the valve closure member to move to the open position, a sealless gas chamber in said housing, a fluid passageway positioned in the housing between the gas chamber and a port for receiving fluid pressure from the well surface for increasing the pressure of the gas in the chamber, piston means movably positioned in the passageway between said gas chamber and said port, said piston means forming a time delay restriction but allowing fluid flow through said passageway for leaving a compressed gas in the gas chamber after the pressure from the well surface is reduced, said piston means connected to said flow tube whereby when pressure on the port side of the piston means is reduced compressed gas in the gas chamber will act on the fluid on the gas chamber side of the piston means to move the piston means in a direction to close the valve.

9. The apparatus of claim 8 including, a check valve in fluid parallel with the piston means for quickly pressuring the gas chamber.

10. The apparatus of claim 9 wherein the gas chamber includes an enclosure with a fluid port at the bottom.

11. The apparatus of claim 8 including, actuator rod means connected between the piston means and said flow tube, said rod exposed on one side to pressure in the bore acting in a direction on said rod to close said valve, and said rod means exposed on a second side to pressure from said port acting in a direction on said rod means to open said valve.

12. The apparatus of claim 11 wherein the cross-sectional area of the piston means is greater than the cross-sectional area of the rod means.

13. The apparatus of claim 8 including, actuator rod means connected between the piston means and said flow tube, said rod means exposed on opposite ends to the pressure in the bore whereby the rod means is insensitive to pressure in the bore.

14. A subsurface well safety valve for controlling the fluid flow through a well conduit comprising, a housing having a bore therethrough, a valve closure member positioned in the housing movable between open and closed positions in the bore, a flow tube longitudinally movable in the housing for controlling the movement of the valve closure member, spring means for biasing the flow tube in a direction for opening the valve, a sealless gas chamber in the said housing, a fluid passageway positioned in the housing between the gas chamber and a port for connecting hydraulic pressure from the well surface for increasing and decreasing the pressure of gas in the chamber, a plurality of displacement pistons positioned in the passageway between said gas chamber and said port, said pistons restricting but allowing fluid flow through said passageway, a plurality of actuator rod means connected between the piston and said flow tube whereby when pressure on the port side of the pistons is reduced compressed gas in the gas chamber will act on the fluid to move the pistons and rods in a direction to close the valve.

15. The apparatus of claim 14 including, a check valve in fluid parallel with the pistons for quickly pressuring the gas chamber.

16. The apparatus of claim 15 including, a valve upstream of said pistons for pressuring the passageway with gas.

* * * * *